US005267835A

United States Patent [19]

Schabdach et al.

[11] Patent Number: 5,267,835

[45] Date of Patent: Dec. 7, 1993

[54] PUMP SPEED CONTROLLER-NUCLEAR HARDENED/TEMPERATURE RESPONSIVE

[75] Inventors: Paul G. Schabdach, Churchville; Irving F. Barditch, Baltimore, both of Md.

[73] Assignee: The United States of America as represented by the Secretary of the Army, Washington, D.C.

[21] Appl. No.: 889,004

[22] Filed: May 26, 1992

[51] Int. Cl.[5] ..... F04B 49/06

[52] U.S. Cl. ..... 417/32; 417/45; 417/53; 318/471

[58] Field of Search ..... 417/32, 45, 53; 318/471, 268, 66, 71

[56] References Cited

U.S. PATENT DOCUMENTS 2,442,149 5/1948 Ruth et al. ..... 318/471

2,940,395 6/1960 Hill ..... 417/32

5,066,197 11/1991 Champane ..... 417/53

FOREIGN PATENT DOCUMENTS 0029852 2/1987 Japan ..... 417/32

*Primary Examiner*—Richard A. Bertsch

*Assistant Examiner*—David W. Scheuermann

*Attorney, Agent, or Firm*—Anthony T. Lane; Edward Goldberg; Michael C. Sachs

[57] ABSTRACT

An apparatus which serves to control automatically the speed of a pump according to the temperature of the oil being pumped from a reservoir. The controller is comprised of a parallel bank of thermal switches each connected to its dropping load resistor through a series isolation relay which places the load on a motor which drives the oil pump directly related to the viscosity of the oil in the reservoir.

2 Claims, 1 Drawing Sheet

PUMP SPEED CONTROLLER-NUCLEAR HARDENED/TEMPERATURE RESPONSIVE

The invention described herein may be manufactured, used and licensed by or for the Government for Governmental purposes without payment to-me/us of any royalties thereon.

BACKGROUND OF THE INVENTION

1. Field of Invention

This invention relates generally to the field of controllers whose function is to automatically adjust pump speed as a function of temperature. It further relates to systems which control the speed of pumps which must vary to adjust to variations in the viscosity of the oil due to fluctuating temperatures, especially under cold conditions and under nuclear warfare conditions.

2. Background of the Invention

The need to efficiently and quickly pump oil from tanks at low temperatures is a military necessity during rapid deployment operations of military forces in cold regions of the world. Such need also exists where ever military units are stationed in cold weather geographical areas. Furthermore this necessity also applies to commercial operations in arctic or cold regions of the world. As oil gets colder, it becomes more viscous and therefore harder to pump from its container. Current apparatus or systems use manual means which turn-up the pump speed as the temperature drops. Such manual systems where drums (rubber, plastic or metal) are quickly deployed filled with oil.

In addition, currently used control systems are vulnerable to nuclear radiation and electromagentic pulse found on the atomic battlefield. This vulnerability arises because currently used control systems are electrical in nature and built using semiconductor devices such as diodes, transistors and SCR's. Such devices are vulnerable to nuclear effects.

This invention, however, allows by the use of a controller in a nuclear environment for the automatic adjustment of the pump speed according to the temperature of the oil.

SUMMARY OF INVENTION

It is the object of this present invention to provide a scheme for the automatic control of the speed of a pump according to the temperature of the stored oil.

It is another object of this invention to provide an apparatus which will be able to effectively compensate for changes in oil viscosity due to temperature changes.

The system embodies a network of temperature preset thermal switches connected to a complex of isolation relays which allow connections to correlated drop resistors increasing or decreasing the load to a motor and hence controlling the speed with which the motor drives the pump.

It is another object of this invention to provide a control system comprised solely of metallic elements; and hence will not be vulnerable to nuclear radiation and electromagnetic pulse, two effects by which semiconductor devices, as a class, are destroyed.

These and other objects of the invention will become apparent to those skilled in the art upon consideration of the following description of the invention.

DETAILED DESCRIPTION OF THE PREFERRED EMBODIMENT

Figure 1:
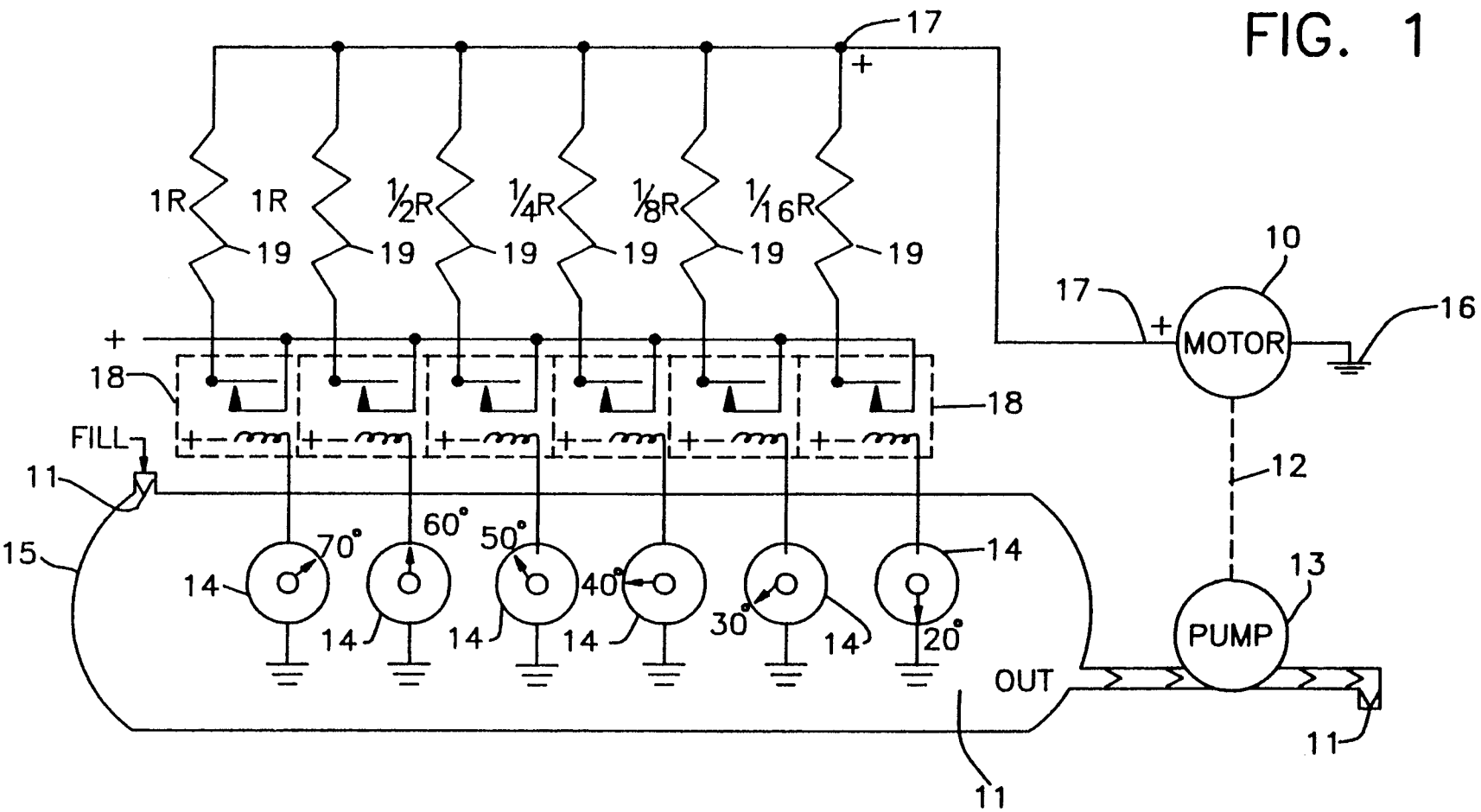
FIG. 1 is an electrical schematic of the controller apparatus.

Turning now to FIG. 1, its shows the controller which automatically can control the motor 10 speed as the viscosity of the oil 11 varies.

The controller is connected to a differential long shunt compound 24 VDC motor 10 which through its shaft 12 is used to drive the oil pump 13. The bank of thermal switches 14 are heat sinked to the oil reservoir 15.

The motor 10 is electrically connected with its negative side to common ground 16 and its positive side 17 to a network of thermal switches 14, connected in parallel, through a bank of isolation relays 18. The isolation relays 18 are used for heavy duty, large current drawing motors 10. Small, low current drawing motors 10 could use the contacts from the thermal switches 14 directly if the contacts were rated high enough to handle the current load. Each thermal switch 14 feeds its own dropping resistor 19 all of which are junctioned at the positive voltage feeding point 17. As the temperature changes, the heat sinked thermal switches 14 sense the change in temperature causing different combinations of the dropping resistors 19 to be switched in and out of the circuit.

The values of the dropping resistors 19 and the thermal set points for each thermal switch 14 are empirically adjusted. Values shown for the dropping resistors 19 and the settings for the thermal switches 14 are provided for illustration only.

Thus it is apparent that in accordance with the present invention, a functional design that fully satisfies the objectives, aims and advantages is set forth above. While the invention has been described in conjunction with a specific embodiment, it is evident that many alternatives, modifications and variations will become apparent to those skilled in the art in light of the foregoing description. Accordingly, it is intended that the present invention embrace all such alternatives, modifications, and variations as fall within the spirit and broad scope of the appended claims.

What is claimed is:

1. A nuclear hardened controller apparatus for automatically adjusting the pump speed according to the temperature of oil to be pumped comprising:

means to generate a voltage differential based on the temperature of the oil in a reservoir;

means to adjust the load to the motor correlated to the viscosity of oil in a reservoir, said means to adjust comprising a network of parallel thermal switches;

means to connect said means for generating voltage differential with those of said means which adjust the load to the motor.

2. A nuclear hardened controller apparatus for automatically adjusting the pump speed according to the temperature of oil to be pumped comprising:

means to generate a voltage differential based on the temperature of the oil in a reservoir;

means to adjust the load to the motor correlated to the viscosity of oil in a reservoir;

means to connect said means for generating the voltage differential with those said means which adjust the load to the motor, said means to connect comprising a network of parallel isolation switches in series with each thermal switch.

* * * * *